US007088051B1

(12) United States Patent
Cok

(10) Patent No.: US 7,088,051 B1
(45) Date of Patent: Aug. 8, 2006

(54) OLED DISPLAY WITH CONTROL

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/102,354

(22) Filed: Apr. 8, 2005

(51) Int. Cl.
*G09G 3/10* (2006.01)
*G09G 3/30* (2006.01)

(52) U.S. Cl. ..... 315/169.1; 345/76

(58) Field of Classification Search ..... 315/169.1–3; 345/204, 55, 76
See application file for complete search history.

(56) References Cited

U.S. PATENT DOCUMENTS 6,670,773 B1 12/2003 Nakamura et al.
6,738,031 B1 * 5/2004 Young et al. ..... 345/55
6,753,655 B1 * 6/2004 Chen et al. ..... 315/169.3
6,777,888 B1 8/2004 Kondo
6,809,710 B1 10/2004 Prache et al.
2001/0055008 A1 * 12/2001 Young et al. ..... 345/204
2003/0170491 A1 9/2003 Liao et al.
2004/0056604 A1 * 3/2004 Shih et al. ..... 315/169.2
2004/0207614 A1 * 10/2004 Yamashita et al. ..... 345/211
2004/0227706 A1 * 11/2004 Sung ..... 345/76
2005/0105031 A1 * 5/2005 Shih et al. ..... 349/139
2006/0028407 A1 * 2/2006 Chou ..... 345/76

FOREIGN PATENT DOCUMENTS

WO 03/034389 4/2003
WO 2004/036536 4/2004

* cited by examiner

*Primary Examiner*—Thuy V. Tran
*Assistant Examiner*—Hung Tran Vy
(74) *Attorney, Agent, or Firm*—Andrew J. Anderson

(57) ABSTRACT

An OLED device and control circuit, comprising: a) an OLED responsive to a drive signal; b) a drive circuit connected to the OLED responsive to a charge signal for controlling the drive signal; c) one or more variable charge storage capacitors providing the charge signal; d) a deposition circuit for depositing variable charge in the one or more variable charge storage capacitors; and e) a modulation circuit responsive to an external modulation signal for removing charge from the one or more variable charge storage capacitors.

20 Claims, 4 Drawing Sheets

OLED DISPLAY WITH CONTROL

FIELD OF THE INVENTION

The present invention relates to solid-state display devices and means to store and display pixel values and images.

BACKGROUND OF THE INVENTION

Solid-state image display devices utilizing light-emissive pixels are well known and widely used. For example, OLED devices are used in flat-panel displays, in both passive- and active-matrix configurations, and in both top-emitter and bottom-emitter designs. Control circuits for OLED displays are also well known in the art and include both voltage- and current-controlled schemes.

Conventional passive-matrix OLED displays employ a variable current in combination with a fixed period during which the OLED light-emitting element emits light. Successive rows or columns of OLED elements are energized and the entire OLED display is refreshed at a rate sufficient to avoid the appearance of flicker. For example, WO2003034389 A2 entitled "System and Method for Providing Pulse Amplitude Modulation for OLED Display Drivers" published Apr. 24, 2003 describes a pulse width modulation driver for an organic light emitting diode display. One embodiment of a video display comprises a voltage driver for providing a selected voltage to drive an organic light emitting diode in a video display. The voltage driver may receive voltage information from a correction table that accounts for aging, column resistance, row resistance, and other diode characteristics.

Active-matrix OLED devices suffer from manufacturing variability that leads to non-uniformity in OLED displays. Moreover, the OLED light-emitting elements themselves degrade over time and with use, thereby modifying the light output from the devices in response to control and power signals. Hence, conventional active-matrix drive methods that employ stored charge deposited on a local capacitor at each pixel site to control a drive circuit for driving an OLED light-emitting element, will experience an undesirable variation in light output from element to element.

There are a variety of known schemes for compensating for sources of non-uniformity in an active-matrix OLED display, in particular for variations in drive transistor threshold variation. For example, US20040207614 entitled "Display device of active matrix drive type" describes such a pixel-control circuit. U.S. Pat. No. 6,777,888 entitled "Drive circuit to be used in active matrix type light-emitting element array" describes another such design. However, such circuit designs are typically complex and employ many more elements and control signals. Hence, such an approach may reduce manufacturing yields and reduce the light-emissive area of the OLED device.

Because one source of non-uniformity in an OLED display results from variability in the threshold switching characteristics of thin-film drive transistors employed in active-matrix designs, one approach to improving uniformity in an active-matrix OLED display is to employ pulse-width modulation techniques in contrast to charge-deposition control techniques. These pulse-width modulation techniques operate by driving the OLED at a maximum current and brightness for a specific first amount of time and then turning the OLED off for a second amount of time. If the sum of the first and second amounts of time is sufficiently small, the flicker resulting from turning the OLED on and off periodically will not be perceptible to a viewer. The brightness of the OLED element is then controlled by varying the ratio of amount of time that the OLED is turned on in comparison to the amount of time that the OLED is turned off.

A variety of methods for controlling an OLED display using pulse-width modulation are known. For example, U.S. Pat. No. 6,809,710 entitled "Gray scale pixel driver for electronic display and method of operation therefore" granted Oct. 26, 2004 discloses a circuit for driving an OLED in a graphics display. The circuit employs a current source connected to a terminal of the OLED operating in a switched mode. The current source is responsive to a combination of a selectively set cyclical voltage signal and a cyclical variable amplitude voltage signal. The current source, when switched on, is designed and optimized to supply the OLED with the amount of current necessary for the OLED to achieve maximum luminance. When switched off, the current source blocks the supply of current to the OLED, providing a uniform black level for an OLED display. The apparent luminance of the OLED is controlled by modulating the pulse width of the current supplied to the OLED, thus varying the length of time during which current is supplied to the OLED.

By using a switched mode of operation at the current source, the circuit is able to employ a larger range of voltages to control the luminance values in a current-driven OLED display. However, use of current-driven circuits is complex and requires a large amount of space for each pixel in a display device.

There are also methods known for providing both a pulse width control and a variable charge deposition control in a single circuit. U.S. Pat. No. 6,670,773 entitled "Drive circuit for active matrix light emitting device" suggests a transistor in parallel with an OLED element. The described technique, however, diverts driving current from an OLED, thereby decreasing the operating efficiency of the circuit. Other designs employ circuit elements in series with the OLED element for controlling or measuring the performance of the OLED element. For example, WO2004036536 entitled "Active Matrix Organic Electroluminescent Display Device" published Apr. 29, 2004 illustrates a circuit having additional elements in series with an OLED element. However, when placed in series with an OLED element, transistors will increase the overall voltage necessary to drive the OLED element or may otherwise increase the overall power used by the OLED element or decrease the range of currents available to the OLED element.

An additional problem faced by OLED devices is the change in OLED material characteristics as the OLED elements are used. Typically, the OLED elements become less efficient and have a higher effective resistance. Both of these factors tend to increase the voltage needed to drive current through the OLED element. This increases the overall voltage of the system, inhibiting the brightness of the elements at a given voltage.

Thin-film transistors used to drive a typical active-matrix OLED element also place restrictions on operation. A typical transistor has an operating range defined by its current/voltage characteristics. At low voltages or currents, a transistor will no longer operate in a region with a linear response to changes in control signals. Transistor circuits are designed to operate within a restricted range where the performance of the transistor will behave as desired. If control signals move the transistors out of the restricted operating range, the device will no longer behave as desired.

New OLED materials and structures are under development that greatly reduce the current needed to produce a suitable light output. See, for example, U.S. Patent Publication No. 2003/0170491 by Liang-Sheng L. Liao et al., entitled "Providing an Organic Electroluminescent Device Having Stacked Electroluminescent Units". These structures require changes in driving circuits to provide suitable control within a desired operating region of a transistor circuit.

There is a need therefore for an improved control circuit for active-matrix OLED devices having simplified design, flexible control, and desired operation that does not increase the power used by the circuit.

SUMMARY OF THE INVENTION

In accordance with one embodiment, the invention is directed towards an OLED device and control circuit, comprising:

a) an OLED responsive to a drive signal;

b) a drive circuit connected to the OLED responsive to a charge signal for controlling the drive signal;

c) one or more variable charge storage capacitors providing the charge signal;

d) a deposition circuit for depositing variable charge in the one or more variable charge storage capacitors; and e) a modulation circuit responsive to an external modulation signal for removing charge from the one or more variable charge storage capacitors.

ADVANTAGES

The present invention provides an OLED control device having a simplified control structure while providing improved performance.

DETAILED DESCRIPTION OF THE INVENTION

Figure 1:
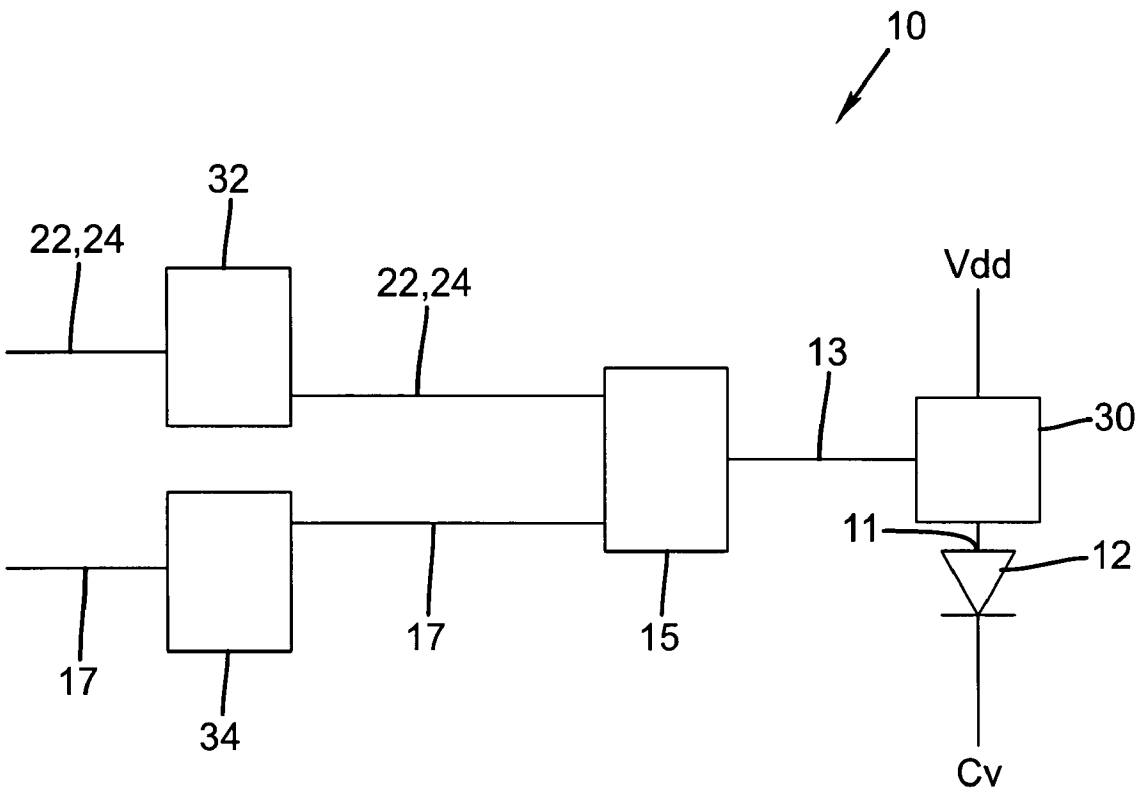
FIG. 1 is a block diagram illustrating the components of the present invention.

Referring to FIG. 1, according to one embodiment of the present invention an OLED device and control circuit 10, comprises an OLED 12 responsive to a drive signal 11; a drive circuit 30 connected to the OLED 12 responsive to a charge signal 13 for controlling the drive signal 11; a variable charge storage circuit 15 connected to the drive circuit 30 and providing the charge signal 13; a deposition circuit 32 responsive to deposition signal 22, 24 (e.g., representing select and data control signals) for depositing variable charge in the variable charge storage circuit 15; and a modulation circuit 34 responsive to an external modulation signal 17 for removing charge from the variable charge storage circuit 15. According to the present invention, the charge deposited in the charge storage circuit 15 will vary depending on the desired brightness of the OLED 12. The phase of the external modulation signal 17 with respect to the deposition signals 22 and 24 is also variable. Hence, the control circuit of the present invention provides independent control of the duration and brightness of an OLED during a refresh period.

Figure 2:
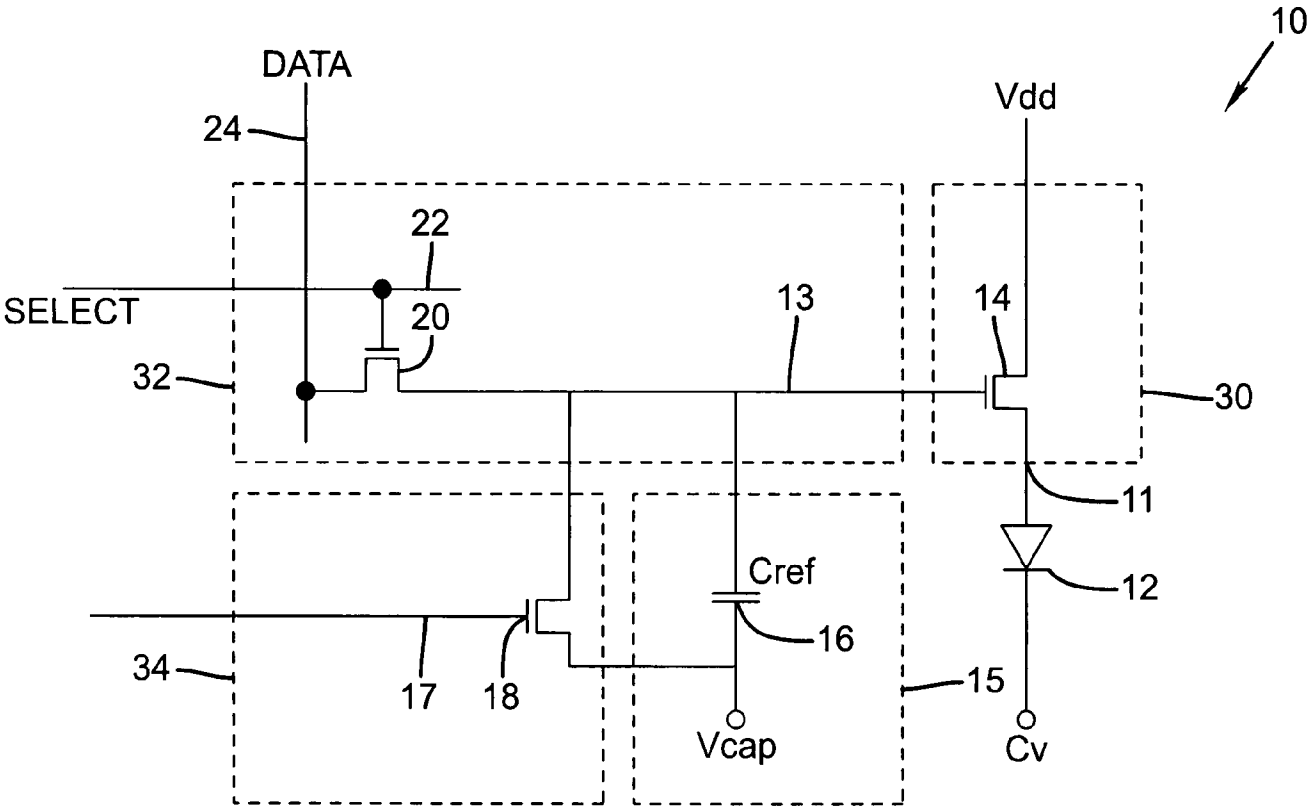
FIG. 2 is a circuit diagram illustrating one embodiment of the present invention.

Referring to FIG. 2, one embodiment of the present invention employs a drive circuit 30 comprising a thin-film drive transistor 14 to drive the OLED 12 from a voltage power supply Vdd to a cathode voltage Cv through the drive signal 11. The drive transistor 14 is responsive to the charge stored on one or more storage capacitors 16 through the charge signal 13. The storage capacitors 16 are charged through a deposition circuit 32 employing a thin-film deposition transistor 20 using control signals 22 (select) and 24 (data) using control methods well known in the OLED art. When employed, a charge modulation transistor 18 responsive to an external modulation signal 17 drains the capacitor 16 of charge.

In operation, the select 22 and data 24 signals turn on deposition transistor 20 to deposit a charge corresponding to the data deposition signal 24 in capacitor 16. The external modulation signal 17 is held low for this operation so that the charge modulation transistor 18 is off. When the capacitor 16 is charged, the drive transistor 14 is proportionally turned on to provide a current flow from the power signal Vdd, through the drive transistor 14 and the OLED 12 to the cathode voltage $C_V$, thereby causing the OLED to emit an amount of light corresponding to the charge on the capacitor 16. After a period of time, the external modulation signal 17 is raised to a high voltage, thereby turning on the charge modulation transistor 18 and causing the charge in the capacitor 16 to drain out. With no, or reduced, charge in the capacitor 16, the drive transistor 14 will provide less current to the OLED 12, thereby reducing the light output of the OLED. In one embodiment, the external modulation signal 17 may be used to completely drain the charge in the capacitor 16 so that the drive transistor 14 is turned off and no current flows through the OLED 12, effectively turning it off. In an alternative embodiment, the external modulation signal 17 may be used to partially drain the charge in the capacitor 16 so that the drive transistor 14 is controlled at one or more selected levels to modify the current flow through the OLED 12, effectively modifying the light output in response to the modulation signal 17.

In a conventional, prior-art flat-panel display, a display signal is typically refreshed periodically at a rate high enough to provide the appearance of smooth motion in sequential frames of a video stream. Refresh rates are typically 30, 60, 70, 75, 80, 90, or 100 frames per second for monitors, 50 or 60 frames per second for televisions, and 24 frames per second for films. Hence, in a conventional flat-panel display, the charge in the variable charge storage circuit 15 is updated at the selected refresh rate appropriate to the application. According to the present invention, after the charge has been refreshed for an OLED element within a given frame, the external modulation signal 17 is applied to reduce the charge in the variable charge storage circuit 15 and change the light output of the OLED 12 before the next time the charge is refreshed in response to the following frame update.

In one embodiment of the present invention, when a desired average brightness over a frame period is desired, the charge deposited in the variable charge storage circuit 15 to drive the drive circuit 30 and OLED 12 is increased above the level necessary to provide an average brightness over the entire refresh period during a first portion of the frame refresh period. During the second portion of the frame refresh period, the charge deposited in the variable charge storage circuit 15 is decreased in response to the external modulation signal 17. Hence, the OLED has a variable brightness during the frame refresh period. Preferably, the refresh period is sufficiently short that the variation in brightness through the period is not perceptible to a viewer. The average brightness of the OLED device is perceived to be the total amount of light emitted during the refresh period. If $P_1$ is defined as the first portion of the frame period P during which the OLED emits light at a brightness $V_1$, and $P_2$ is defined as the second portion of the frame period during with the OLED emits light at a brightness $V_2$, and $P_1+P_2$ equals P, then the average brightness can be calculated as $((V_1*P_1)+(V_2*P_2))/P$.

Figure 3A:
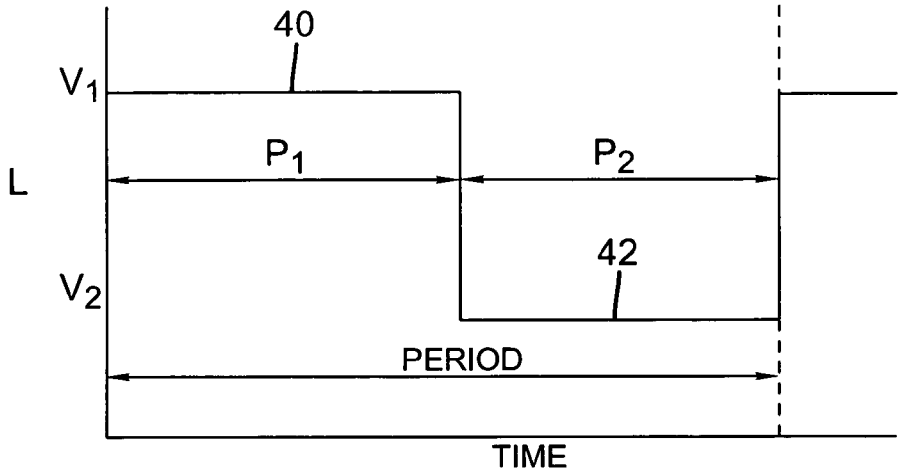
FIGS. 3*a–c* are graphs illustrating the operation of the present invention under various conditions.
Figure 3B:
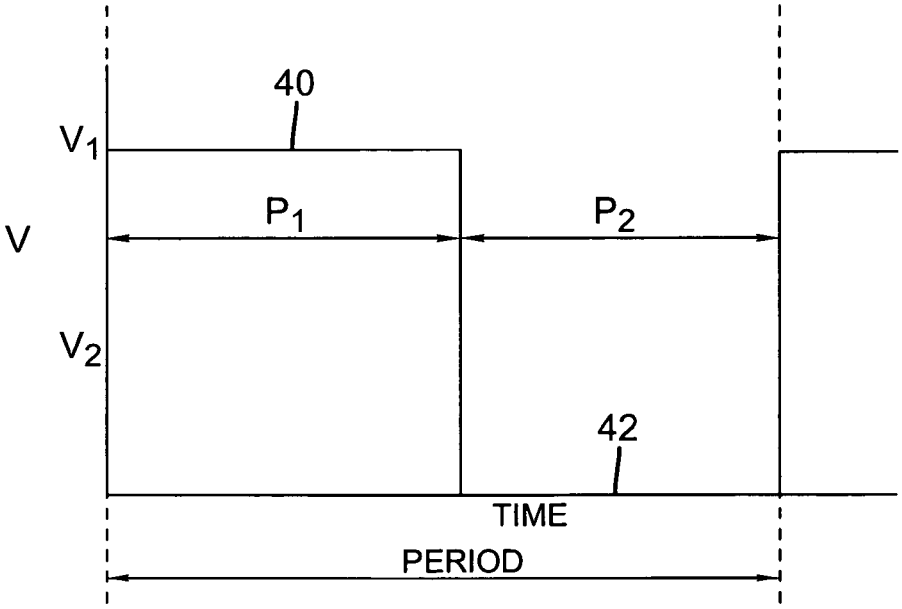
Figure 3C:
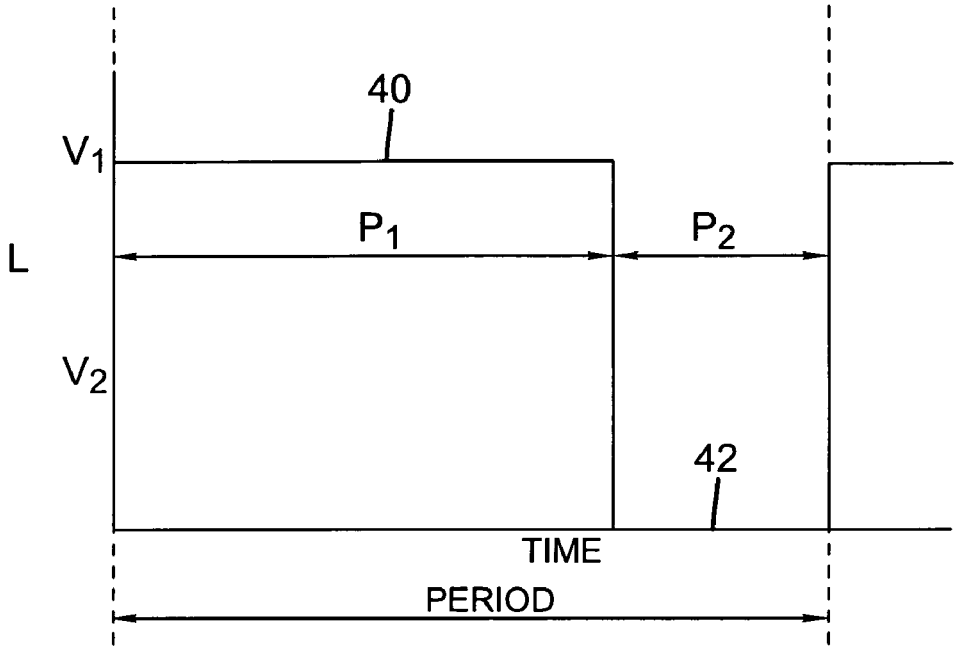

Referring to FIG. 3*a*, a graphic illustration of the operation is shown. Period P of a complete refresh cycle is divided into two portions, $P_1$ and $P_2$. During $P_1$, the brightness L is set at $V_1$ 40 corresponding to a first charge stored in the capacitor(s) 15 and the charge signal 13 supplied to the drive circuit 30. During $P_2$, the brightness L is set at $V_2$ 42 corresponding to a second charge stored in the capacitor(s) 15 and the charge signal 13 supplied to the drive circuit 30. The second charge is lower than the first charge and is reduced by turning on the modulation circuit 34 in response to the external modulation signal 17. At the end of the period P, the cycle repeats for another refresh period; a first charge is deposited in the variable charge storage circuit 15 in response to the control signals 22 and 24 and left there for a time corresponding to $P_1$. At the end of $P_1$, the external modulation signal 17 causes the modulation circuit 34 to reduce the charge in the capacitor(s) 15. As illustrated in FIG. 3*b*, $V_2$ may be zero, so that light is only emitted during $P_1$. As shown in FIG. 3*c*, the ratio of $P_1$ to $P_2$ may be adjusted so that the amount of light emitted during each portion of the period changes to accommodate changes in the OLED device. In effect, the deposition signal and the modulation signal have the same frequency but are out of phase by $P_1$.

According to various embodiments of the present invention, the use of an external modulation signal 17 in combination with the control signals 22 and 24 as described provides various benefits. First, this design does not require the use of a control transistor in series with the OLED element itself (which series element would increases the voltage (Vdd) necessary to drive the OLED, thereby decreasing the efficiency of the system), or a current-diverting transistor in parallel with the OLED (which parallel element diverts current, thereby decreasing the efficiency of the system), while still providing a means to drive an active-matrix OLED element at a variety of levels within a single period.

Figure 4:
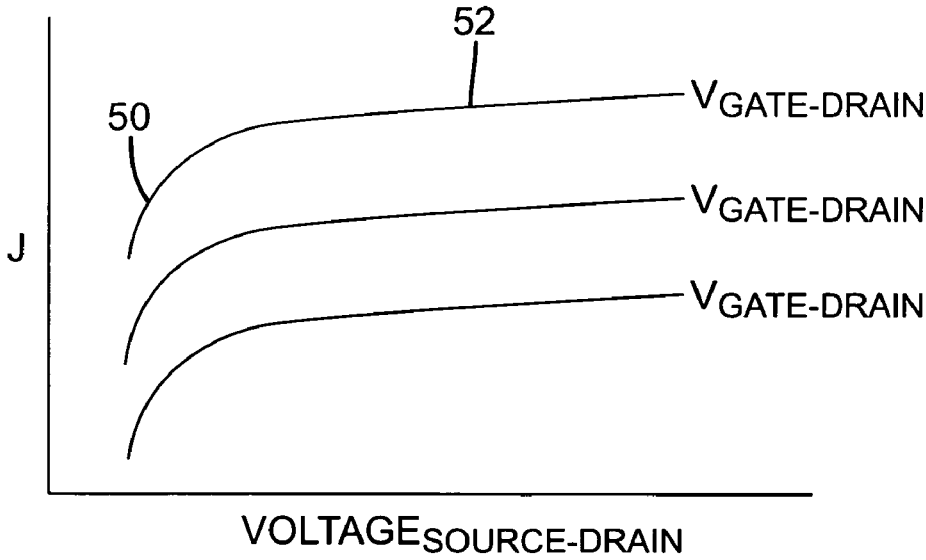
FIG. 4 is a graph illustrating a typical current-voltage behavior of a transistor employed in OLED pixel circuits.

Second, referring to FIG. 4, a conventional current-voltage curve for a thin-film transistor commonly used to drive OLED devices is illustrated. As can be observed from an examination of FIG. 4, at very low voltages, the current that passes through the transistor does not have a substantially linear response. Moreover, the transistor has a minimum turn-on voltage, below which the transistor does not operate. This is problematic for at least two reasons. If a low current is desired in the drive transistor 22 to provide a low-level OLED output, the output response will not be linear. Moreover, as is well-known, OLED devices age with use and the effective resistance to current through the OLED increases, thereby lowering the effective voltage across the driving transistor 12 in FIG. 2 given a constant voltage source Vdd. This can move the operating region of the drive transistor into the non-linear region 50 from the preferred linear operating region 52. While constant-current sources may be employed to counter-act this effect, such circuits are much more complex. However, the present invention may be employed with a wide variety of drive circuits 30, including constant-voltage and constant-current circuits.

While the aging of OLED elements can reduce the current through an OLED element and cause driving transistors to problematically operate in a non-linear region, new materials and OLED structures may also have a similar effect. Applicant has demonstrated materials that are much more efficient at producing light in response to current than those commercially available today. Moreover, stacked structures can greatly reduce the current needed to produce a suitable light output. See, for example, U.S. Patent Publication No. 2003/0170491 referenced above. Hence, these materials and structures require much lower currents than are used in commercial applications today.

The use of a combination of variable brightness and variable duration provides a simple technique for operating low-current OLED materials and structures. Instead of operating in non-preferred operating regions to get a desired light output for such low-current devices, by providing a higher current to the OLED during a first portion of a refresh cycle, driving transistors may be operated in their preferred operating region during such first portion. During the remaining second portion of the period, the OLED may not be driven at all, and hence need not be driven in a non-preferred operating region.

In a typical pulse-width modulation scheme of the prior art, an OLED is driven at a constant, high brightness for a data-dependant variable portion of a period. In this scheme, data must be written at least twice in every period, to turn the OLED on and then off again. This scheme also requires that a large OLED drive current be used, reducing the lifetime of the materials, and that a complex, very high rate control signal be employed to control the variable pulse width. The variable pulse width must be controlled to within at least one $256^{th}$ of a period to support an 8-bit gray scale display. This can be difficult to accomplish. By combining a variable charge and a variable period, the OLED drive current necessary may be reduced and the pulse width control may be greatly simplified. For example, data may be written only once, and only a few different pulse widths may be used, such as two or four. Hence, a third advantage of the present invention is simplified control. The variable charge deposited in the capacitor(s) may be modified to accommodate changes in the pulse widths.

The present invention may also be employed to compensate for changes in the operating characteristics of an OLED element. As OLED are used, their efficiency drops and resistance increases. By extending the length of the first portion of the refresh period with respect to the second portion of the refresh period, more light may be emitted by the device, thereby compensating for the reduced light output efficiency of the OLED element. In this case, the change in efficiency of the OLED materials directly affects the change in $P_1$. For example, the ratio R of $P_1$ to P may be increased as the relative efficiency $E_T$ at time T of the OLED materials decreases. Over time, as the efficiency of the OLED materials decreases, $E_T$ Will likewise decrease, and R may be increased to $R=R_{initial}/E_T$, where $R_{initial}$ is the initial ratio of $P_1$ to P. R cannot exceed 1.0 (the point of maximum compensation possible), and $E_T$ is <=1.0.

The initial brightness value $V_1$ of the control signal during the first portion $P_1$ may be a predetermined maximum value $V_{Max}$ corresponding to the desired brightness of the OLED elements divided by R and representing a maximum quantity of light output from the light-emitting elements for $P_1$. $V_{Max}$ and $P_1$ will be set based on the desired brightness, the desired lifetime of the OLED display, and the lifetime of the light-emitting materials in the OLED.

As is known, deposit-and-hold circuits such as may be found in active matrix OLED display devices may lead to perceptual blurring if an observer's eye attempts to track a moving object across the display device screen. By modulating the charge in the variable storage capacitor 16 to reduce the length of time the OLED is emitting light, this blurring effect may be reduced. The present invention thus may be employed to more simply reduce motion artifacts in such display devices.

The present invention may be employed in a display having a plurality of OLED light-emitting elements and associated active-matrix circuits. These light-emitting elements may be organized in rows and columns and the control signals supplied to them may drive rows or columns at a time. The external modulation signal may be connected to all of the OLED elements in common, so that a single control structure operates all of the modulation circuitry. Alternatively, separate modulation signals may be employed for groups of OLEDS, for example groups may comprise all of the OLED elements that emit light of a particular color in a color display. Since different OLED materials are employed in a color display to emit different colors and age at different rates, it can be advantageous to control each OLED color-element grouping separately. Typically, the data and select control signals refresh lines or columns in a display at a time; the same method of cycling through the rows or columns may be employed to control the modulation signal so that each OLED commonly connected to a modulation signal will be updated one row or column at a time and cause the OLED to emit light for the same amount of time.

An OLED controller suitable for use with the present invention can be constructed using conventional digital logic control methods. The circuit control signals may be applied using conventional designs.

In a preferred embodiment, the invention is employed in an emissive display that includes Organic Light Emitting Diodes (OLEDs) which are composed of small molecule or polymeric OLEDs as disclosed in but not limited to U.S. Pat. No. 4,769,292, issued Sep. 6, 1988 to Tang et al., entitled "Electroluminescent Device with Modified Thin Film Luminescent Zone" and U.S. Pat. No. 5,061,569, issued Oct. 29, 1991 to VanSlyke et al., entitled "Electroluminescent Device with Organic Electroluminescent Medium". Many combinations and variations of OLED materials and architectures are available to those knowledgeable in the art, and can be used to fabricate an OLED display device according to the present invention.

The invention has been described in detail with particular reference to certain preferred embodiments thereof, but it will be understood that variations and modifications can be effected within the spirit and scope of the invention.

PARTS LIST

10 OLED device and control circuit
11 drive signal
12 OLED
13 charge signal
14 drive transistor
15 variable charge storage circuit
16 capacitor
17 modulation signal
18 charge modulation transistor
20 deposition transistor
22 select deposition signal
24 data deposition signal
30 drive circuit
32 deposition circuit
34 modulation circuit
40 first voltage level
42 second voltage level
50 Non-linear operating region
52 substantially linear operating region

The invention claimed is:

1. An OLED device and control circuit, comprising:
a) an OLED responsive to a drive signal;
b) a drive circuit connected to the OLED responsive to a charge signal for controlling the drive signal;
c) one or more variable charge storage capacitors providing the charge signal;
d) a deposition circuit for depositing variable charge in the one or more variable charge storage capacitors; and
e) a modulation circuit responsive to an external modulation signal for removing charge from the one or more variable charge storage capacitors.

2. The OLED device and control circuit claimed in claim 1, wherein the deposition circuit is responsive to a deposition signal that periodically refreshes the charge in the one or more variable charge storage capacitors, and wherein the modulation signal has a common frequency and period with the deposition signal, but differs in phase from the deposition signal.

3. The OLED device and control circuit claimed in claim 1, wherein the deposition circuit is responsive to a deposition signal that periodically refreshes the charge in the one or more variable charge storage capacitors, and wherein the modulation circuit responsive to the external modulation signal changes the charge in the one or more variable charge storage capacitors after the charge has been refreshed and each time the charge has been refreshed.

4. The OLED device and control circuit claimed in claim 3, wherein the variable capacitor charge is decreased.

5. The OLED device and control circuit claimed in claim 4, wherein the variable capacitor charge is removed.

6. The OLED device and control circuit claimed in claim 1, wherein the deposition circuit is responsive to a deposition signal that periodically refreshes the charge in the one or more variable charge storage capacitors, and wherein the OLED emits light at a first level for a first portion of each refresh period and emits light at a second level for a second portion of each refresh period.

7. The OLED device and control circuit claimed in claim 6, wherein the OLED does not emit any light for the second portion of each refresh period.

8. The OLED device and control circuit claimed in claim 6, wherein the drive circuit has a preferred operating range and wherein the drive circuit is operated inside the preferred operating range during the first portion and does not operate within the preferred range during the second portion.

9. The OLED device and control circuit claimed in claim 8, wherein the length of the first portion is chosen to cause the OLED to output the desired amount of light and to cause the display driver to operate in the preferred range.

10. The OLED device and control circuit claimed in claim 6, wherein the length of the first portion is chosen to compensate for the aging of the OLED.

11. The OLED device and control circuit claimed in claim 1, further comprising a plurality of OLEDs with associated modulation circuits connected to a common external modulation signal.

12. The OLED device and control circuit claimed in claim 11, wherein the device comprises OLEDs that emit light of different colors, and wherein the plurality of OLEDs connected to the common external modulation signal are OLEDs that emit light of the same color.

13. The OLED device and control circuit claimed in claim 1, wherein the drive circuit is a voltage-controlled drive circuit or a current-controlled drive circuit.

14. An OLED device and control circuit claimed in claim 1, wheren the OLED device is an OLED display comprising:

a plurality of OLEDs, each responsive to a drive circuit; the drive circuit of each OLED responsive to a storage circuit; the storage circuit of each OLED responsive to a control signal for storing a variable signal in the storage circuit, and the storage circuit responsive to a modulation signal for modifying the stored signal; and a controller for providing control and modulation signals to each storage circuit;

wherein the periodic control signal to each storage circuit has a period P for refreshing a stored first value in the storage circuit; the modulation signal has the same period P but a different phase for modifying the stored value in the storage circuit to a stored second value; and the drive circuit drives the OLED at a first brightness $V_1$ corresponding to the stored first value and at a second brightness $V_2$ corresponding to the second stored value.

15. The control system of claim 14 wherein the perceived brightness of an OLED is determined by $((V_1*P_1)+(V_2*P_2))/P$, where $P_1$ is the time between the beginning of the period P and the beginning of the modulation signal for modifying the stored signal and $P_2$ is the time between the beginning of the modulation signal and the end of the period P.

16. The control system of claim 15 wherein $V_2$ is zero.

17. The control system of claim 15 wherein $P_1$ is determined by the relative efficiency of the OLEDs.

18. The control system of claim 15 wherein R is the ratio of $P_1$ and P, $R_{initial}$ is the initial value of R, $E_T$ is the relative efficiency of the light emitting materials at time T, and the ratio of P1 and P is changed over time in accordance with $R=R_{initial}/E_T$.

19. The control system of claim 18 wherein the value $V_1$ of the control signal during the first portion $P_1$ is a predetermined maximum value $V_{Max}$ corresponding to the desired brightness of the OLED elements divided by the ratio of $P_1$ and P.

20. The control system of claim 14 wherein the period P is equal to the period of a frame refresh of a video signal.

* * * * *